US006871401B1

(12) United States Patent
Blankenship

(10) Patent No.: US 6,871,401 B1
(45) Date of Patent: Mar. 29, 2005

(54) TOOL FOR INSERTING AND REMOVING A CORPORATION STOP AND METHOD FOR USE THEREOF

(76) Inventor: Mike Blankenship, P.O. Box 6052, Tallahassee, FL (US) 32314

( * ) Notice: Subject to any disclaimer, the term of this patent is extended or adjusted under 35 U.S.C. 154(b) by 4 days.

(21) Appl. No.: 10/213,458

(22) Filed: Aug. 6, 2002

(51) Int. Cl.[7] ..... B21K 1/20; B25B 13/00

(52) U.S. Cl. ..... 29/890.124; 29/890.14; 29/890.12; 29/213.1; 81/124.4; 81/124.6; 81/124.2

(58) Field of Search ..... 81/124.4, 124.5, 81/124.6, 124.7, 124.2, 124.3, 176.15, 176.2, 81/121.1; 29/890.124, 213.1, 890.12

(56) References Cited

U.S. PATENT DOCUMENTS

| | | | | |
|---|---|---|---|---|
| 604,622 | A | 5/1898 | Lobdell et al. | |
| 1,195,294 | A * | 8/1916 | Trubey | 81/63.2 |
| 1,789,079 | A | 1/1931 | Simpson et al. | |
| 2,099,479 | A | 11/1937 | Heinkel et al. | 137/13 |
| 2,212,972 | A | 8/1940 | Armstrong | 81/53 |
| 2,566,502 | A | 9/1951 | Smith | 137/73 |
| 3,038,484 | A | 6/1962 | Smith | 137/15 |
| 3,580,270 | A | 5/1971 | Leopold, Jr. et al. | 137/318 |
| 3,779,272 | A | 12/1973 | Dunmire | 137/315 |
| 4,682,624 | A | 7/1987 | Turner | 137/318 |
| 4,823,650 | A * | 4/1989 | Tuttle | 81/124.2 |
| 4,836,065 | A * | 6/1989 | Setliff | 81/124.2 |
| 4,922,951 | A | 5/1990 | Webster | 137/321 |
| D319,171 | S * | 8/1991 | McCord, Jr. | D8/70 |
| 5,199,145 | A | 4/1993 | McMillan et al. | 29/237 |
| 5,694,971 | A | 12/1997 | Wilcock | 137/318 |
| 5,697,268 | A * | 12/1997 | Makovsky et al. | 81/125 |
| 5,730,180 | A | 3/1998 | Alberico | 137/367 |
| 5,737,822 | A | 4/1998 | Driver et al. | 29/450 |
| 5,988,199 | A | 11/1999 | Ryan et al. | 137/15 |
| 6,062,110 | A * | 5/2000 | Julio et al. | 81/124.2 |
| 6,314,841 | B1 * | 11/2001 | Burk et al. | 81/125.1 |
| 6,609,445 | B2 * | 8/2003 | Elmore | 81/124.2 |
| 6,698,317 | B1 * | 3/2004 | Machovsky | 81/124.2 |
| 6,715,384 | B1 * | 4/2004 | Kozak | 81/124.2 |
| 2002/0194966 | A1 * | 12/2002 | Elmore | 81/124.2 |

* cited by examiner

*Primary Examiner*—Marc Jimenez
(74) *Attorney, Agent, or Firm*—Peter Loffler

(57) ABSTRACT

An insertion tool for attaching a corporation stop onto a tapping saddle uses a body member that has a top with an opening therein, an open bottom, a first side, a second side, a third side opposite the first side, and a fourth side opposite the second side. A generally rectangular-shaped first notch is located on the first side of the body member while a generally U-shaped second notch is located on the third side. A corporation stop having a shank, a valve handle and a valve packing is provided such that the shank of the corporation stop is received within the body member, the valve handle is received within the first notch, and the valve packing is received within the second notch. An extension of a socket wrench is received within the opening and the socket wrench is used to turn the body member and thus the corporation stop.

7 Claims, 4 Drawing Sheets

TOOL FOR INSERTING AND REMOVING A CORPORATION STOP AND METHOD FOR USE THEREOF

BACKGROUND OF THE INVENTION

1. Field of the Invention

The present invention relates to a tool and method for inserting and removing corporation stops that are threadably secured to a tapping saddle.

2. Background of the Prior Art

In tapping into a main, such as a water main or a gas main, a tapping saddle is used to encompass the main at the desired point of tapping, a tap is made into the main, and a corporation stop is threadably received into the tapping saddle and into the tap that is made in the main. Thereafter, a branch line is connected to the opposing end of the corporation stop with a valve on the corporation stop being used to establish and terminate fluid flow communication between the main line and the branch line. This system, which is in wide spread use, works with great efficiency, however, a drawback can be found.

In attaching the corporation stop to the tapping saddle and the main line, the installers tend to use a large plumber's wrench or similar device to threadably twist the corporation stop to the tapping saddle and thereafter to remove the corporation stop therefrom. As the corporation stop is made from copper, brass, or other relatively soft material, improper use of the insertion and removal can cause damage to the corporation stop. If the installer uses the shank portion of the corporation stop— the portion of the corporation stop to which the branch line is attached—the wrench can cause compression of the shank portion taking the shank portion out of its round configuration. As a result, the branch line may not be able to couple to the shank portion or if a coupling is made, a proper seal may not be established between the branch line and the shank portion of the corporation stop. If the installer uses the wrench to grasp the corporation stop at its threaded base, the potential for stripping the threading on the base is high which can result in the threaded base not being properly received within its female threaded counterpart on the tapping saddle, and may additionally result in the threaded base of the corporation stop becoming jammed within the tapping saddle, making it extremely difficult to subsequently decouple the corporation stop from the tapping saddle. If the installer uses the wrench to grasp the corporation stop at the stop's valve and packing assembly, the valve can become jammed such that it becomes inoperational. In any scenario, without exercising a large amount of due care— which may be hard to come by in a rushed environment—damage to the corporation stop as well as an improper installation of the corporation stop can occur.

Therefore, there exists a need in the art for a tool that can quickly and easily attach a corporation stop to and detach a corporation stop from a tapping saddle, which tool assures that a correct installation of corporation stop to the tapping saddle as well as the subsequent installation of a branch line to the shank portion of the corporation stop occurs. Use of such a tool must also minimize the potential for damage to the corporation stop. Ideally, such a tool is of relatively simple design and construction and is relatively easy to use and maintain.

SUMMARY OF THE INVENTION

The tool for inserting and removing a corporation stop and method for use thereof addresses the aforementioned needs in the art. Specifically, the tool allows for a corporation stop to be quickly and easily attached to and detached from a tapping saddle. The tool assures that a correct installation of corporation stop to the tapping saddle as well as the subsequent installation of a branch line to the shank portion of the corporation stop occurs. Use of the tool for inserting and removing a corporation stop and method for use thereof minimizes the potential for damage to the corporation stop during the installation and removal processes. The tool is of relatively simple design and construction and is relatively easy to use and maintain.

The tool for inserting and removing a corporation stop and method for use thereof is comprised of a body member that has a top with an opening therein, an open bottom, a first side, a second side, a third side opposite the first side, and a fourth side opposite the second side. A generally rectangular-shaped first notch is located on the first side of the body member and extends from the bottom while a generally U-shaped second notch is located on the third side and also extends from the bottom. The opening on the top of the body member is generally rectangular in shape. A corporation stop having a shank, a valve handle and a valve packing is provided such that the shank of the corporation stop is received within the body member through the open bottom, the valve handle is received within the first notch, and the valve packing is received within the second notch. A socket wrench having an extension is provided such that the extension is received within the opening and the socket wrench is used to turn the body member and thus the corporation stop. A slit is located in at least one of the first side, the second side, the third side, or the fourth side of the body member and is used to turn the valve handle of the corporation stop.

BRIEF DESCRIPTION OF THE DRAWINGS

Similar reference numerals refer to similar parts throughout the several views of the drawings.

DESCRIPTION OF THE PREFERRED EMBODIMENT

Figure 2:
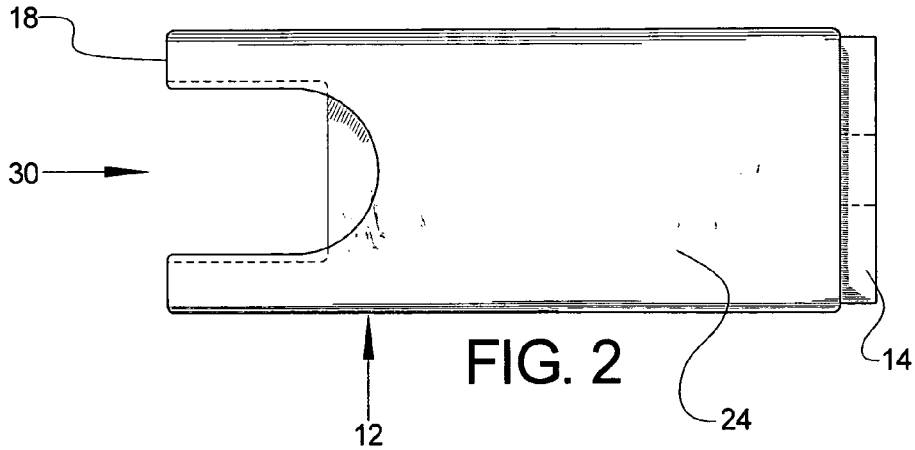
FIG. 2 is a front elevation view of the tool for inserting and removing a corporation stop.
Figure 1:
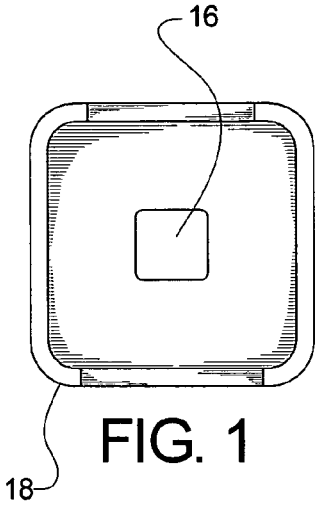
FIG. 1 is a top plane view of the tool for inserting and removing a corporation stop of the present invention.
Figure 3:
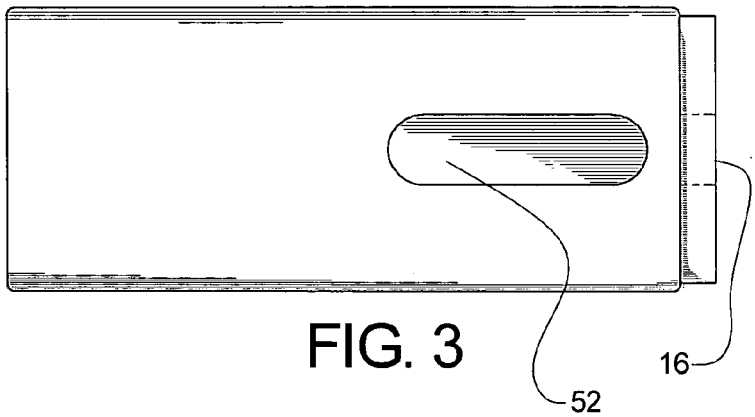
FIG. 3 is a side elevation view of the tool for inserting and removing a corporation stop.
Figure 4:
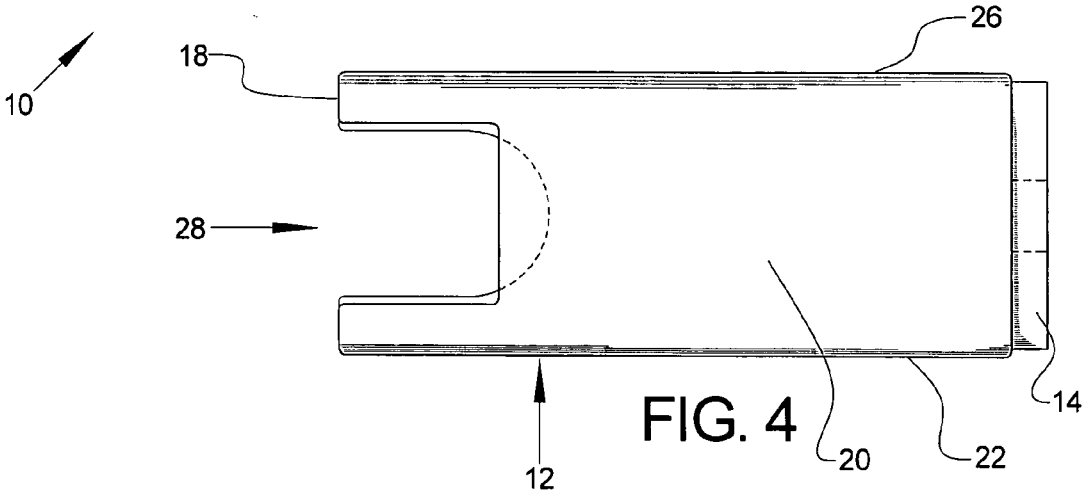
FIG. 4 is a rear elevation view of the tool for inserting and removing a corporation stop.
Figure 5:
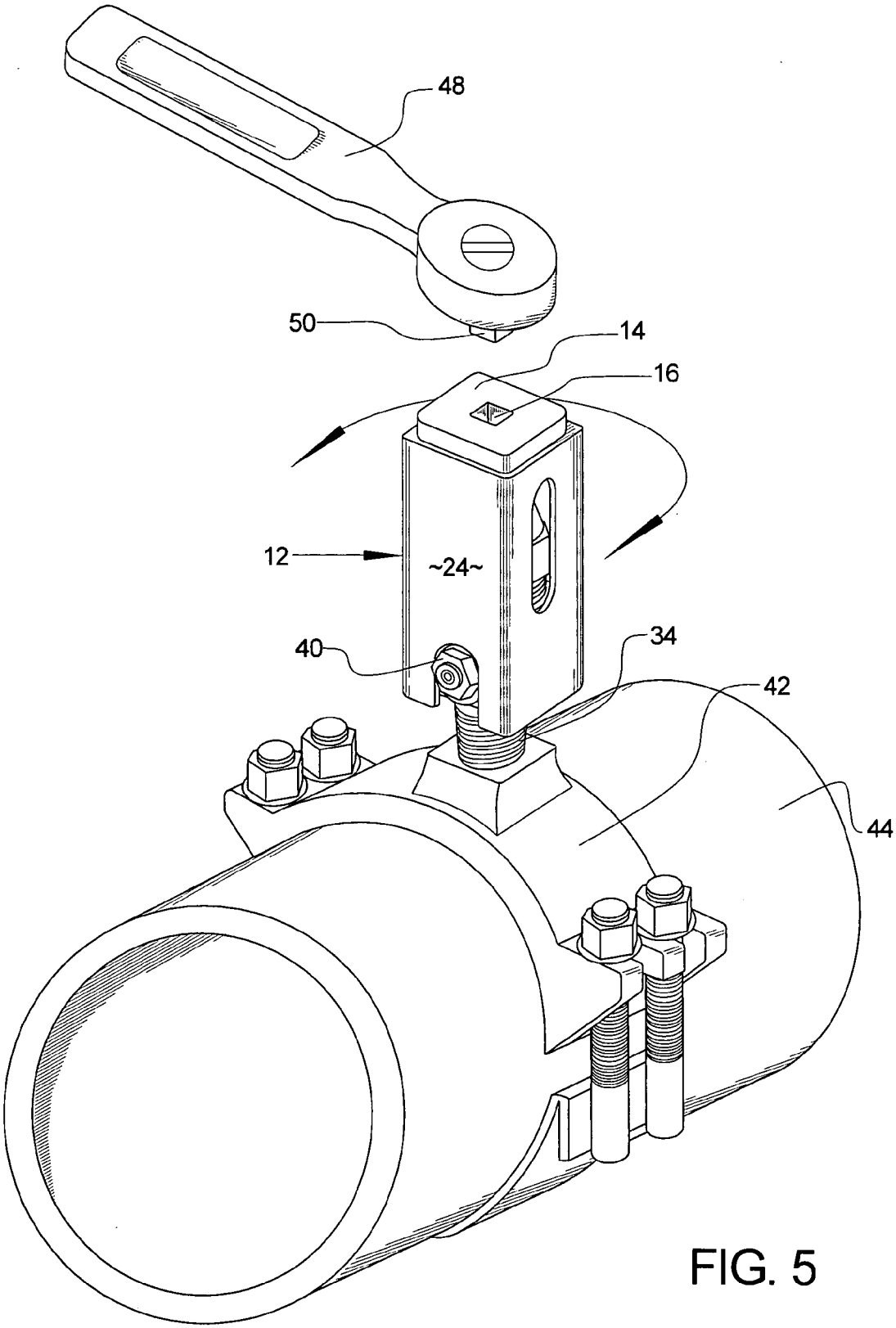
FIG. 5 is an environmental view of the tool for inserting and removing a corporation stop attached to a corporation stop.
Figure 6:
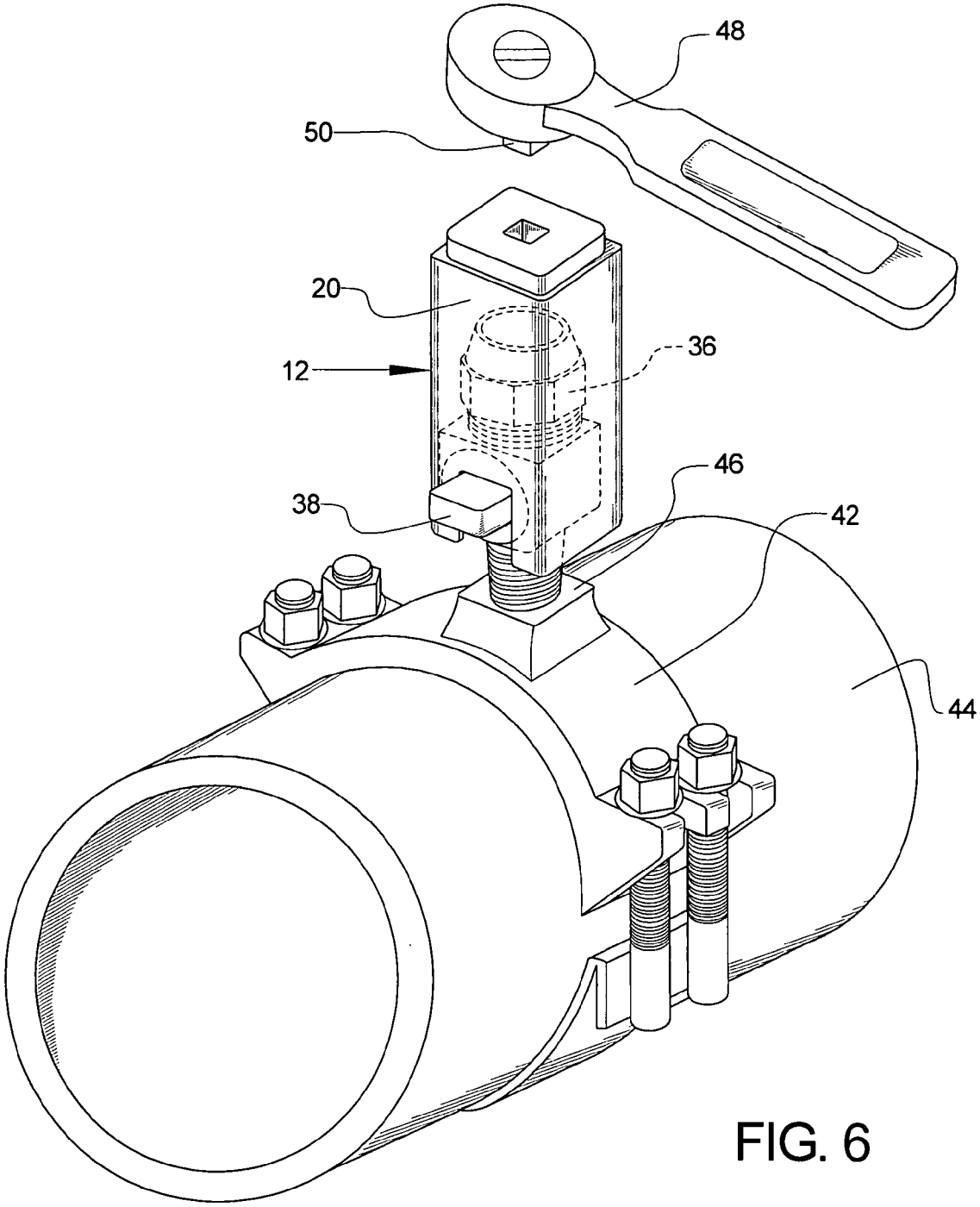
FIG. 6 is an environmental view of the tool for inserting and removing a corporation stop attached to the corporation stop after the corporation stop has been rotated 180 degrees relative to the corporation stop in FIG. 5.
Figure 7A:
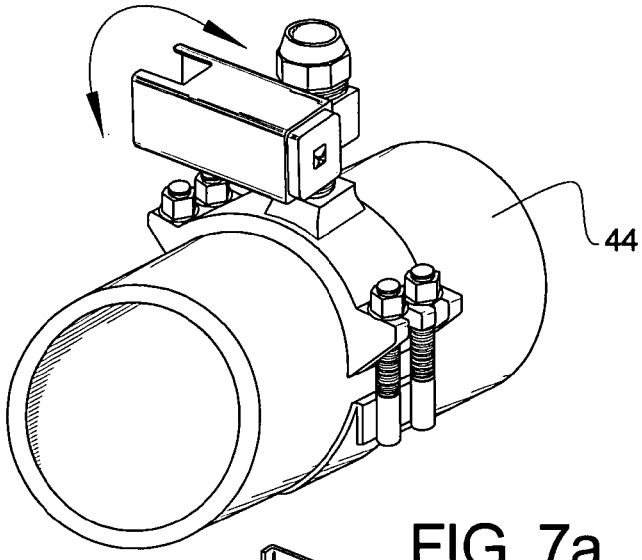
FIGS. 7*a*-7*c* illustrate the tool for inserting and removing a corporation stop turning the valve of the corporation stop.
Figure 7B:
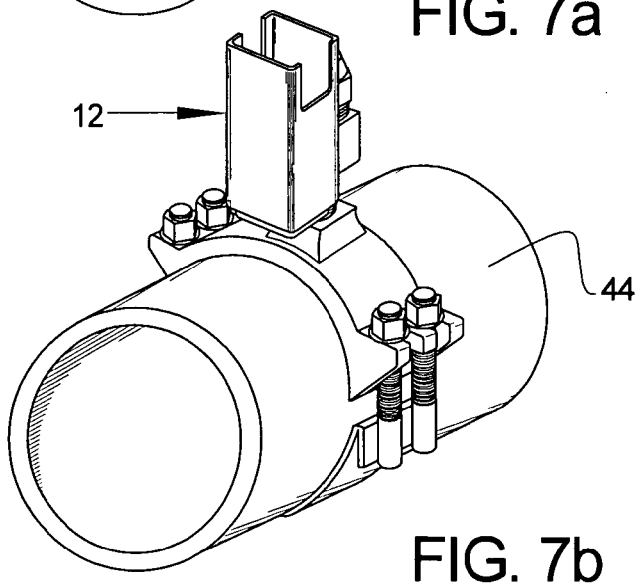
Figure 7C:
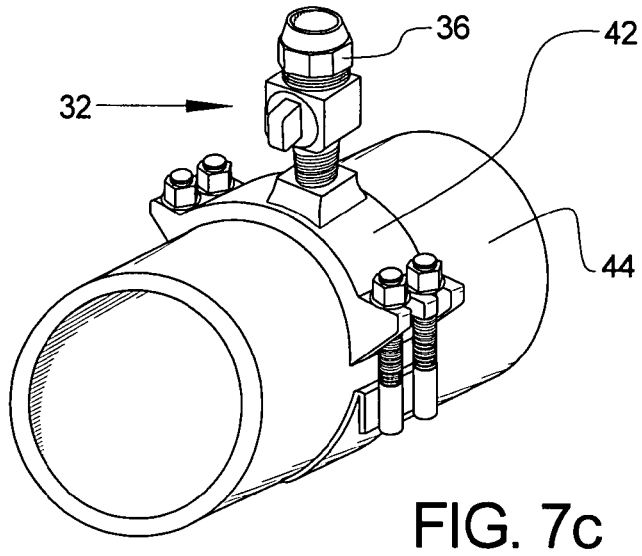

Referring now to the drawings, it is seen that the tool for inserting and removing a corporation stop and method for use thereof, generally denoted by reference numeral 10, is comprised of a generally rectangular shaped body member 12 that has a top 14 with an opening 16 therein, an open bottom 18, a first side 20, a second side 22, a third side 24 opposite the first side 20, and a fourth side 26 opposite the second side 22. The body member 12 is made from any appropriate durable material such as steel or aluminum. A generally rectangular-shaped first notch 28 is located on the first side 20 of the body member 12 and extends from the bottom 18 while a generally U-shaped second notch 30 is located on the third side 24 of the body member 12 and extends from the bottom 18. The opening 16 on the top 14 of the body member 12 is generally rectangular in shape.

A corporation stop 32 having a threaded shaft 34, a shank 36, a valve handle 38 and a valve packing 40 is provided. A tapping saddle 42 is positioned about a main line 44 such that the tapping saddle 42 has a female threaded receptacle 46 positioned at the desired location to place a tap into the main line 44. The corporation stop 32 is positioned such that its shaft 34 is received within the receptacle 46 of the tapping saddle 34. The body member 12 is positioned over the corporation stop 32 such that the shank 36 of the corporation stop 32 is received within the body member 12 through the open bottom 18 of the body member 12, the valve handle 38 of the corporation stop 32 is received within the first notch 28 of the body member 12, and the valve packing 40 of the corporation stop 32 is received within the second notch 30 of the body member 12. The height of the first notch 28 from the bottom 18 of the body member 12 is approximately equal to the height of the second notch 30 so that the valve handle 38, in its horizontal position, rests snugly within the top of the first notch 28 and the valve packing 40 rests snugly within the top of the second notch 30.

A standard socket wrench 48 having an extension 50 is provided such that the extension 50 is received within the opening 16 on the top 14 of the body member 12 and the socket wrench 48 is used to turn the body member 12 and thus the corporation stop 32. As the main contact points between the body member 12 and the corporation stop 32 is at the valve handle 38 and the valve packing 40 and their respective notches 28 and 30, the body member 12 acts on these two members—the valve handle 38 and the valve packing 40—during corporation stop 32 rotation via the socket wrench 48. The corporation stop 32 is rotated until it is firmly received within the tapping saddle 42 and thus the tap point of the main line 44. In order to remove the corporation stop 32 from the tapping saddle 42, the direction of rotation of the socket wrench 48 is reversed and the corporation stop 32 is counterrotated until it is free of the tapping saddle 42.

A slit 52 is located in at least one of the first side 20, the second side 22, the third side 24, or the fourth side 26 of the body member 12. Once the corporation stop 32 is installed onto the tapping saddle 42, the body member 12 is removed from atop the corporation stop 32 and is positioned such that the valve handle 38 of the corporation stop 32 is received within the slit 52 of the body member 12 and the body member 12 is rotated or counterrotated in order to turn the valve handle 38 (and thus the valve which the valve handle 38 controls) to an on or off position.

While the invention has been particularly shown and described with reference to an embodiment thereof, it will be appreciated by those skilled in the art that various changes in form and detail may be made without departing from the spirit and scope of the invention.

I claim:

1. A method for installing a corporation stop having a threaded shaft, a shank, a valve handle, and a valve packing, to the threaded female receptacle of a tapping saddle comprising the steps of:

positioning the shaft of the corporation stop within the receptacle of the tapping saddle;

providing a body member having a top with an opening therein, an open bottom, a first side, a second side, a third side opposite the first side, a fourth side opposite the second side, a generally rectangular-shaped first notch having a side edge along its periphery, the first notch located on the first side extending from the bottom, and a generally U-shaped second notch located on the third side extending from the bottom;

positioning the body member such that the shank of the corporation stop is received within the body member through the open bottom, the valve handle is received within the first notch and abuts up against the side edge of the first notch, and the valve packing is received within the second notch;

providing a socket wrench having an extension; and positioning the extension such that the extension is received within the opening and the socket wrench is used to turn the body member.

2. The method as in claim 1 wherein the opening is generally rectangular in shape.

3. The method as in claim 1 further comprising the steps of:

providing a slit in at least one of the first side, the second side, the third side, or the fourth side of the body member;

positioning the body member such that the valve handle of the corporation stop is received within the slit; and using the slit to rotate the valve handle.

4. The method as in claim 1 wherein the body member is generally rectangular in shape.

5. A method for installing a corporation stop having a threaded shaft, a shank, a valve handle, and a valve packing, to the threaded female receptacle of a tapping saddle comprising the steps of:

positioning the shaft of the corporation stop within the receptacle of the tapping saddle;

providing a body member having a top with an opening therein, an open bottom, a first side, a second side, a third side opposite the first side, a fourth side opposite the second side, a generally rectangular-shaped first notch located on the first side extending from the bottom, and a generally U-shaped second notch located on the third side extending from the bottom;

positioning the body member such that the shank of the corporation stop is received within the body member through the open bottom, the valve handle is received within the first notch, and the valve packing is received within the second notch;

providing a socket wrench having an extension;

positioning the extension such that the extension is received within the opening and the socket wrench is used to turn the body member;

providing a slit in one of the first side, the second side, the third side, or the fourth side of the body member;

positioning the body member such that the valve handle of the corporation stop is radially received within the slit; and using the slit to rotate the valve handle by axially rotating the body member.

6. The method as in claim 5 wherein the opening is generally rectangular in shape.

7. The method as in claim 5 wherein the body member is generally rectangular in shape.

* * * * *